US005364692A

United States Patent [19]

Bowen, Jr. et al.

[11] Patent Number: 5,364,692

[45] Date of Patent: Nov. 15, 1994

[54] HEAT SET SPIRAL LINK FABRIC WITH MODIFIED STUFFER YARNS

[75] Inventors: David Bowen, Jr., St. Augustine, Fla.; Gerald L. Smith, Summerville, S.C.

[73] Assignee: Scapa Group, PLC, Blackburn, England

[21] Appl. No.: 174,543

[22] Filed: Dec. 28, 1993

[51] Int. Cl.[5] ..... D03D 13/00

[52] U.S. Cl. ..... 428/222; 34/116; 139/383 A; 198/851; 428/223; 428/257; 428/293; 428/294; 428/296; 428/397

[58] Field of Search ..... 428/222, 223, 293, 294, 428/296, 397, 257; 198/844.1, 851; 162/348, DIG. 1; 34/116; 139/383 A

[56] References Cited

U.S. PATENT DOCUMENTS

| | | | |
|---|---|---|---|
| 4,381,612 | 5/1983 | Shank | 34/116 |
| 4,395,308 | 7/1983 | Dawes | 428/222 |
| 4,481,079 | 11/1984 | Dawes | 428/222 |
| 4,755,420 | 7/1988 | Baker et al. | 428/222 |
| 4,839,213 | 6/1989 | Gauthier | 428/114 |
| 5,104,724 | 4/1992 | Hsu | 428/222 |

*Primary Examiner*—James J. Bell
*Attorney, Agent, or Firm*—Keck, Mahin & Cate

[57] ABSTRACT

A stuffed spiral link fabric, providing a supporting surface for transporting a web includes a plurality of synthetic spiral coil members connected together serially by elongated hinge members extending through intermeshed portions of adjacent intermeshing spiral coil members to form a spiral link fabric and a plurality of elongated shaped synthetic stuffer yarns extending through central portions of the spiral coil members to form a stuffed spiral link fabric. The stuffed spiral link fabric is heat set to form a fabric in which each spiral coil member has a cross sectional shape having arcuate ends joined by substantially straight portions and a central portion of each spiral coil member is substantially filled with a stuffer yarn which engages and is clamped to each intermeshed portion adjacent thereto, reducing the air and moisture permeability of the fabric and increasing the fabric stability. The stuffer yarn is modified in shape and trapped in place in the spiral fabric by the heat setting step. A method for making the heat set stuffed spiral link fabric is described.

18 Claims, 1 Drawing Sheet

HEAT SET SPIRAL LINK FABRIC WITH MODIFIED STUFFER YARNS

FIELD OF THE INVENTION

The invention relates to spiral link fabric having stuffer yarns inserted in the spirals and locked in place by heat setting which modifies the shape of the spiral link fabric and the stuffer yarns, for use particularly for dryer felts in papermaking, conveyor Pelts or filtration media.

BACKGROUND OF THE INVENTION

Non-woven structures are known for use as conveyor belts, for example, as dryer felts or fabrics in papermaking applications. In particular, non-woven fabrics made from a plurality of intermeshed spiral coils that extend in side-by-side relationship in the cross-machine direction and in which adjacent coils are joined together by cross-machine direction hinge members, are useful for papermaker's dryer fabrics. In some cases the spiral fabric is excessively permeable to air and moisture. The permeability may be reduced by inserting a stuffer through the coils between the hinge members of the fabric.

An advantage of spiral link fabric belts is that the smooth, open, monofilament structure greatly reduces the amount of process contaminants held by the belt and enables the belt to withstand flattening, imparting a constant permeability to the belt:. This is necessary for drying paper evenly (British Patent No. GB-B-2,051,154). However, the high permeability of 500–1000 cfm creates a boundary layer of air within and on the surface of the belt, thereby disturbing the conveying of a sheet from one drying cylinder to another due to air being pumped through the permeable fabric. To reduce the permeability, stuffer materials are introduced into the spirals, such as tape, monofilament or flat yarn (British Patent No. GB-B-2,083,431), filler strands which are then subjected to heat treatment to create expansion of the coil (U.S. Pat. No. 4,381,612), open cell elastomeric foam material (British Patent No. GB-B-2,148,337), elastomeric strips introduced into the coils under tension and then released to effect an expansion of the coil (German patent DE 3,907,561) and tapes having a regular array of holes (U.S. Pat. No. 4,839,213). Permeabilities of 150–500 cfm can be achieved using such modified spiral fabrics. However, flat multi-/monofilaments tend to work out of the fabric if the edge sealant becomes damaged, and multifilament stuffer yarns have a tendency to hold more process contaminants than is acceptable. Additionally multifilaments are prone to damage if high pressure cleaning systems are employed.

SUMMARY OF THE INVENTION

A spiral link fabric, having flattened machine-roll contacting and web-receiving surfaces for use, in a non-limiting example, for transporting a web of paper over dryer rolls in a papermaking machine, has synthetic spiral coil members connected together serially by elongated hinge members extending through intermeshed portions of adjacent intermeshing spiral coil members. Elongated monofilament stuffer yarns extend through central portions of the spiral coil members to form a stuffed spiral coil fabric. The stuffed spiral link fabric, in which each stuffed spiral coil member is substantially oval in shape, is then heat set to form a fabric in which each spiral coil member has arcuate end portions joined by substantially straight portions and the elongated shaped monofilament stuffer yarn substantially fills a central portion of each spiral coil member. This reduces the permeability of the fabric. In preferred embodiments, he shaped monofilament stuffer yarns have a modified X-shaped, T-shaped or/\-shaped cross section. Other shapes for the stuffer yarns may be used as long as the "arms" may be easily distorted to conform to the shape of, and substantially fill, the space in which the stuffer yarns are inserted during heat setting, thus substantially sealing the spaces in the fabric.

By carefully controlling the internal cross section of non-heat treated spiral link fabrics to an oval shape, designing a specially shaped elongated monofilament stuffer yarn to precisely fit into this open area and then heat setting the fabric, the open area is reduced in the vertical direction. This enables the air permeability and moisture permeability of the fabric to be reduced as well as modifying the shape of the stuffer yarns and locking the stuffer yarns in place, thereby also providing improved fabric stability.

Modified cross section monofilament stuffer yarns for spiral link fabrics are described which are locked into place during fabric finishing, by heat setting, by means of vertical compression or shrinkage of the central tunnel portions of the spiral fabric, between the hinge members. Locking the modified X-shaped cross section monofilament stuffer yarns into place in the spiral fabric modifies the shape of the spiral fabric and the stuffer yarns and traps the stuffer yarns in the spiral fabric, preventing the stuffer yarns from working out of the spiral fabric, and sealing the stuffer yarns in place.

The monofilament stuffer yarn having a cross section shaped as a modified X, or a closely derived shape, heat set and held in a spiral link fabric of improved stability allows the stuffed spiral fabric to have a permeability of less than 450 cfm, using the structure described in which the fabric and stuffer yarns are vertically compressed.

A method for making the stuffed spiral link fabric, described above, includes heat setting the stuffed spiral link fabric sufficiently for each monofilament stuffer to engage the adjacent intermeshed portions of the spiral link fabric and to fill the central portion of each spiral coil member.

It is an object of the invention to provide a heat set spiral link fabric of stuffed monofilament spiral coil construction having reduced permeability.

It is another object of the invention to provide a heat set stuffed spiral link fabric having flattened web-receiving and machine-roll contacting surfaces and in which the central portion of the coils is substantially filled with a monofilament stuffer fixed therein during the heat setting process for providing stability and reduced moisture permeability.

It is a further object of the invention to provide a method for heat setting a fabric of spiral construction having flattened paper-receiving and machine-roll contacting surfaces and in which the central portion of the coils is substantially filled with a monofilament stuffer fixed therein for providing stability and reduced moisture permeability.

DETAILED DESCRIPTION OF THE PREFERRED EMBODIMENTS

A spiral link fabric providing a supporting surface for transporting a web, such as a web of paper, includes a plurality of synthetic spiral coil members linked together serially by elongated hinge members extending through intermeshed portions of adjacent intermeshing spiral coil members and a plurality of elongated synthetic stuffer yarn members extending through central portions of the spiral coil members to form a stuffed spiral link fabric. The stuffed spiral link fabric is heat set to form a fabric in which each spiral coil member has a cross sectional shape having arcuate ends joined by substantially straight portions which form flattened web-receiving and machine-roll contacting surfaces. A central portion of each heat set spiral coil member is substantially filled with a stuffer yarn which engages each intermeshed portion adjacent thereto, thereby reducing the permeability of the fabric. Stuffer yarns may be of any suitable cross section which, after heat setting, substantially fills the central portion of the spiral coil member through which it extends and is clamped therein. The spiral link fabric has improved stability and an air permeability of less than 450 cfm (cu.ft./sq.ft/-min.).

The stuffer yarns located within the spiral coil members lock into place during a heat setting step, thereby reducing permeability of the belt and improving belt stability.

By carefully controlling the internal cross section of the non heat-treated spiral link fabric to an oval shape, and designing a shaped monofilament stuffer yarn to precisely fit into this oval shaped open area and then heat setting the stuffed fabric, the stuffed oval shaped area is reduced in height in a direction perpendicular to the plane of the fabric. This enables air and moisture permeability to be reduced as well as locking the stuffer members into place, thereby providing a significant improvement in fabric stability.

The stuffed spiral fabric may be used, for example, for papermaker's fabric, conveyor belting and filtration devices.

Figure 1:
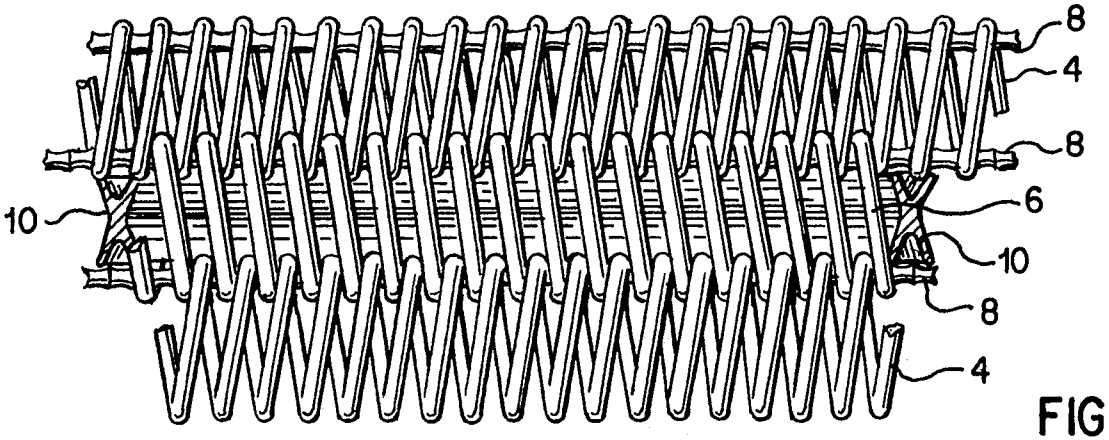
FIG. 1 is a fragmentary top plan view of a stuffed spiral link fabric of the invention.

Referring now to the drawings in which like numerals represent like elements, FIG. 1 shows a spiral link fabric 2 having a plurality of adjacent spiral coil members 4, 6. Spiral coil members 4, 6 are wound in opposite directions and arranged alternately in interdigitated side-by-side disposition, connected together by hinge members 8 engaged in the tunnels formed by the overlapping regions of adjacent coil members.

A central tunnel portion of each spiral coil member 4, 6 is substantially filled with an elongated monofilament stuffer yarn 10 which engages each intermeshed portion adjacent thereto, thereby reducing the moisture permeability and increasing the stability of the fabric. Stuffer members 10 are preferably of modified X-shaped cross section or a related shape which, after heat setting, substantially fills the central portion of the spiral coil member 4, 6 through which it extends and is clamped therein.

Figure 3B:
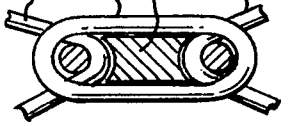
FIG. 3*b* is a fragmentary cross sectional view of the stuffed fabric of FIG. 3*a*, after heat setting.
Figure 3A:
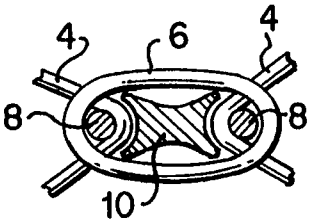
FIG. 3*a* is a fragmentary cross sectional view cf the stuffed fabric of FIG. 1, before heat setting.
Figure 2B:
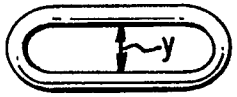
FIG. 2*b* is a fragmentary cross sectional view of unstuffed fabric of FIG. 1, after heat setting.
Figure 2A:
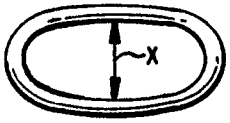
FIG. 2*a* is a fragmentary cross sectional view of unstuffed fabric of FIG. 1, before heat setting.

Before heat setting, each spiral coil member has a substantially oval shape with a height x, as shown, schematically in FIG. 2*a*. When the spiral fabric is heat set, shrinkage occurs and the spiral coil members change shape to a "race-track" configuration having a height y, as shown schematically in FIG. 2*b*, in which arcuate ends are connected by substantially straight portions. The height of the spiral coil member is reduced ($x>y$) during heat-setting. When an elongated monofilament stuffer yarn 10 is present in a spiral coil member 6, before heat setting, as shown in FIG. 3*a*, gaps are present around the stuffer yarn 10, which is loosely held in the spiral coil member. After heat setting, as shown in FIG. 3*b*, the shape of stuffer yarn 10' is modified as yarn 10' is compressed and locked into the central tunnel portion of the spiral coil member 6' and the shape of stuffer yarn 10' becomes distorted to block the tunnel in the central portion. When the central tunnel portion is blocked and substantial gaps are no longer present around stuffer yarn 10, the permeability of the fabric is reduced.

Figure 4B:
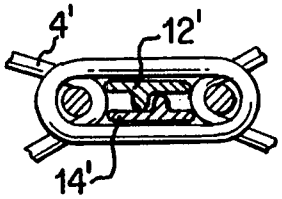
FIG. 4*b* is a fragmentary cross sectional view of the stuffed fabric of FIG. 4*a*, after heat setting.
Figure 4A:
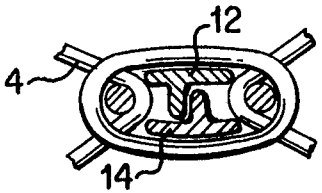
FIG. 4*a* is a fragmentary cross sectional view of a stuffed fabric having two stuffer yarns extending through a tunnel portion.

FIGS. 4*a* and 4*b* show an example of two stuffer yarns in a central tunnel portion of the spiral link fabric before and after heat setting. FIG. 4*a* shows spiral link fabric 4 having two T-shaped stuffer yarns 12, 14, in a central tunnel portion of the fabric. FIG. 4*b* shows that, after heat-setting, the two T-shaped stuffer yarns 12', 14' have become flatter in shape to substantially fill the central tunnel portion of the spiral link fabric 4', thus reducing permeability of the fabric.

Figure 5:
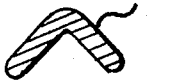
FIG. 5 is a cross-sectional view of another shape of stuffer yarn.

FIG. 5 shows an alternative shape for a stuffer yarn. Stuffer yarn 16 is/\-shaped and is suitable for use alone in a tunnel portion or two /\-shaped stuffer yarns may be used together in a tunnel portion. The arms of the /\-shaped stuffer yarn 16 of FIG. 5 are distorted on heat-setting to substantially fill the central tunnel portion of the spiral link fabric.

Filling the central tunnel portions of the spiral coil members with the stuffer yarns and locking the stuffer yarns in place by heat setting provides increased stability and reduced permeability for the fabric. The central tunnel portions are no longer substantially permeable as the locked in place monofilament stuffer yarn blocks the passage of air and water through the fabric. Because the tunnel portions are substantially filled, the fabric is stable and not likely to become distorted.

The shape and material of the elongated monofilament stuffer yarn 10 is selected according to the use for which the fabric is intended. For example, if the fabric is intended for fabricating into an endless belt for use in a dryer section of a papermaking machine, the material should be capable of maintaining its structural and dimensional integrity and withstanding the temperature and other conditions present in the environment in which it will be used.

Other shapes for the stuffer yarns may be used as long as the "arms" may be easily distorted to conform to the shape of, and preferably substantially fill, the space in which the stuffer yarns are inserted, during heat setting. A modified X, T or /\-shaped stuffer yarn may be used and these stuffer yarns are clamped into the spiral link fabric structure during heat setting.

More than one elongated stuffer yarn may be used to fill the space in each spiral link tunnel portion, if necessary. Two or more stuffer yarns of the same or different shapes may be stuffed through the length of a tunnel portion. On heat-setting, the two or more stuffer yarns are clamped into the structure of the spiral link fabric.

In a non-limiting example, the initial distance between the hinge member centers is about 4.5 mm and the internal opening length of the central portion is about 1.8 to 2.2 mm. Following heat setting, the opening height is reduced from about 2.5 mm to about 1.3 mm, which provides very good clamping of the stuffer members.

While the invention has been described above with respect to certain embodiments thereof, it will be apparent to those skilled in the art that variations and modifications may be made without departing from the spirit and scope of the invention, and that such variations and modifications are encompassed within the scope of the appended claims.

What is claimed is:

1. A heat set stuffed spiral link fabric for providing a supporting surface for transporting a web comprising:

a plurality of synthetic spiral coil members connected together serially by elongated hinge members extending through intermeshed portions of adjacent intermeshing spiral coil members; and a plurality of elongated monofilament stuffer yarns having a modified X-shaped cross section each extending through a central portion of one of said spiral coil members to form a stuffed spiral link fabric;

wherein said stuffed spiral link fabric is heat set to modify the X-shaped cross section of said elongated monofilament stuffer yarns whereby a stuffer yarn substantially fills a central portion of each said spiral coil member and each said stuffer yarn is locked into place in the spiral link fabric.

2. A spiral link fabric according to claim 1 wherein each spiral coil member comprises arcuate end portions joined by substantially straight portions therebetween.

3. A spiral link fabric according to claim 2 wherein each of the spiral coil members and stuffer yarns are reduced in height in a direction perpendicular to the plane of the spiral fabric, after heat setting.

4. A spiral link fabric according to claim 1 wherein each said stuffer yarn engages each intermeshed portion of the fabric adjacent thereto and is locked into place therewith.

5. A spiral link fabric according to claim 3 wherein, in a direction perpendicular to the plane of heat set spiral fabric each said stuffer yarn is substantially the same height as an interior distance across a spiral coil member between said substantially straight portions of each spiral coil member.

6. A spiral link fabric according to claim 4 wherein each said stuffer yarn is substantially the same size and shape in cross section as the cross section of a central tunnel portion of the spiral fabric.

7. A spiral link fabric according to claim 1 having an air permeability of less than 450 cfm.

8. A heat set stuffed spiral link fabric for providing a supporting surface for transporting a web comprising:

a plurality of synthetic spiral coil members connected together serially by elongated hinge members extending through intermeshed portions of adjacent intermeshing spiral coil members; and a plurality of elongated monofilament stuffer yarns each extending through a central portion of one of said spiral coil members to form a stuffed spiral link fabric;

wherein said stuffed spiral link fabric is heat set to modify the cross section of each of said elongated monofilament stuffer yarns and each said stuffer yarn is distorted in shape to substantially fill a central tunnel portion of each said spiral coil member and is clamped into place in the spiral link fabric.

9. A spiral link fabric according to claim 8 wherein more than one stuffer yarn extends through a central tunnel portion of a spiral coil member of the fabric.

10. A spiral link fabric according to claim 8 comprising stuffer yarn having a cross sectional shape selected from X-shape, T-shape and ⋀-shape.

11. A spiral link fabric according to claim 9 comprising stuffer yarn having a cross sectional shape selected from X-shape, T-shape and ⋀-shape.

12. A stuffer yarn for a spiral link fabric comprising an elongated monofilament which when stuffed in a central tunnel portion of the spiral link fabric has a cross sectional shape which is modified by heat setting to a shape having a reduced height in a plane perpendicular to the plane of the spiral link fabric and which is locked into place in the heat set spiral link fabric.

13. A stuffer yarn according to claim 12 having a cross sectional shape selected from X-shape, T-shape and ⋀-shape.

14. A method for reducing the permeability of spiral link fabric comprising:

connecting a plurality of synthetic spiral coil members together serially by elongated hinge members extending through intermeshed portions of adjacent intermeshing spiral coil members;

inserting an elongated synthetic stuffer member having a modified X-shaped cross section through a central tunnel portion of each cf said hinged spiral coil members to form a stuffed spiral link fabric;

heat setting said stuffed spiral link fabric for reducing the permeability thereof, forming a fabric in which each spiral coil member is shrunk to a cross sectional shape having arcuate ends joined by substantially straight portions and a central portion of each said spiral coil member is substantially filled with one of said stuffer members; and locking said stuffer members into said spiral link fabric during heat setting.

15. A method according to claim 14, comprising heat setting said fabric sufficiently for each said stuffer member to be distorted and engage each intermeshed portion adjacent thereto.

16. A method according to claim 14 comprising reducing said stuffer members in height in a direction perpendicular to the plane of the spiral link fabric during the heat setting step.

17. A method according to claim 14 comprising heat setting said stuffed fabric sufficiently to reduce the air permeability to less than 450 cfm.

18. A method for reducing the permeability of spiral link fabric comprising:

connecting a plurality of synthetic spiral coil members together serially by elongated hinge members extending through intermeshed portions of adjacent intermeshing spiral coil members;

inserting at least one elongated synthetic stuffer member having a cross-sectional shape selected from X-shaped, T-shaped and ⋀-shaped, through a central tunnel portion of each of said hinged spiral coil members to form a stuffed spiral link fabric;

heat setting said stuffed spiral link fabric for reducing the permeability thereof, forming a fabric in which each spiral coil member is shrunk to a cross sectional shape having arcuate ends joined by substantially straight portions and each said stuffer member distorted in shape whereby a central portion of each said spiral coil member is substantially filled with said stuffer members; and locking said stuffer members into said spiral link fabric during heat setting.

* * * * *